United States Patent [19]

Riebeek

[11] Patent Number: 4,631,429

[45] Date of Patent: Dec. 23, 1986

[54] HIGH VOLTAGE COMPRESSING INPUT BUFFER

[75] Inventor: G. Fred Riebeek, San Jose, Calif.

[73] Assignee: American Microsystems, Inc., Santa Clara, Calif.

[21] Appl. No.: 638,434

[22] Filed: Aug. 7, 1984

[51] Int. Cl.[4] ..... G06G 7/12

[52] U.S. Cl. ..... 307/490; 307/494; 328/144; 310/318

[58] Field of Search ..... 307/475, 494, 359, 530, 307/490; 330/277; 328/144, 145; 310/314, 318

[56] References Cited

U.S. PATENT DOCUMENTS 4,163,909 9/1979 Harr ..... 307/359
4,328,434 5/1982 Geller ..... 307/359

*Primary Examiner*—Stanley D. Miller
*Assistant Examiner*—B. P. Davis
*Attorney, Agent, or Firm*—Steven F. Caserza; Alan H. MacPherson; Kenneth E. Leeds

[57] ABSTRACT

A circuit (40) is capable of receiving a very high voltage input signal, for example from a piezoelectric transducer (1). The circuit accepts the relatively large input voltage of the piezoelectric transducer (1) and provides an output signal proportional to the square root of the input voltage.

2 Claims, 3 Drawing Figures

HIGH VOLTAGE COMPRESSING INPUT BUFFER

BACKGROUND OF THE INVENTION

This invention relates to integrated circuit input buffer circuits. More specifically, a circuit constructed in accordance with this invention allows an integrated circuit to accept a large negative voltage as an input signal. One example of a specific application of this large input signal buffering circuit is as an input buffer for a piezoelectric transducer input signal.

A piezoelectric transducer is a device which converts a physical force, i.e. a "push" or a "pull", directly into an electrical signal. The operation of a piezoelectric transducer can be likened to a charged capacitor which has movable plates. When the plates of this fictitious capacitor are pulled apart, the capacitance decreases. The voltage across a capacitor is determined by the equation, V=Q/C where, V is the voltage across the capacitor, Q is the electric charge stored in the capacitor, and C is the capacitance of the capacitor.

For a given electrical charge, when the value of C decreases, the voltage across the capacitor increases. Depending on the force applied to the piezoelectric transducer, the voltage across the piezoelectric transducer may be very large, possibly as much as 200 volts. Typical bipolar devices, such as a 2N3906 PNP device, have breakdown voltages of approximately 40 volts. Typical metal oxide semiconductor (MOS) devices have breakdown voltages of approximately 30 volts. Therefore, the voltage provided by a piezoelectric transducer cannot be directly placed between any of the leads of a bipolar or MOS device without destroying that device.

Previous methods for receiving high voltage input signals have used nonintegrated heavy duty resistors as a voltage divider network to reduce the level of the voltage transmitted to the integrated circuit. See Mellen, et al., "Low Noise-High Gain JFET Amplifier For A Piezoelectric Transducer", U.S. Pat. No. 4,214,215, which is hereby incorporated by reference. The use of nonintegrated components is undesirable in that each nonintegrated component must by separately installed in the circuit and separately constructed, thereby increasing the cost of manufacturing the circuit. Accordingly, one goal of the present invention is to provide means for buffering a high voltage input signal using a minimum of components external to an integrated circuit.

SUMMARY

In accordance with this invention means for accepting a transient high voltage, such as from a piezoelectric transducer, is constructed using MOS integrated circuitry. All but two components of the circuit may be placed in an integrated circuit. The two components which must be discrete components are the transient high voltage source itself and a resistor.

DETAILED DESCRIPTION

Figure 1:
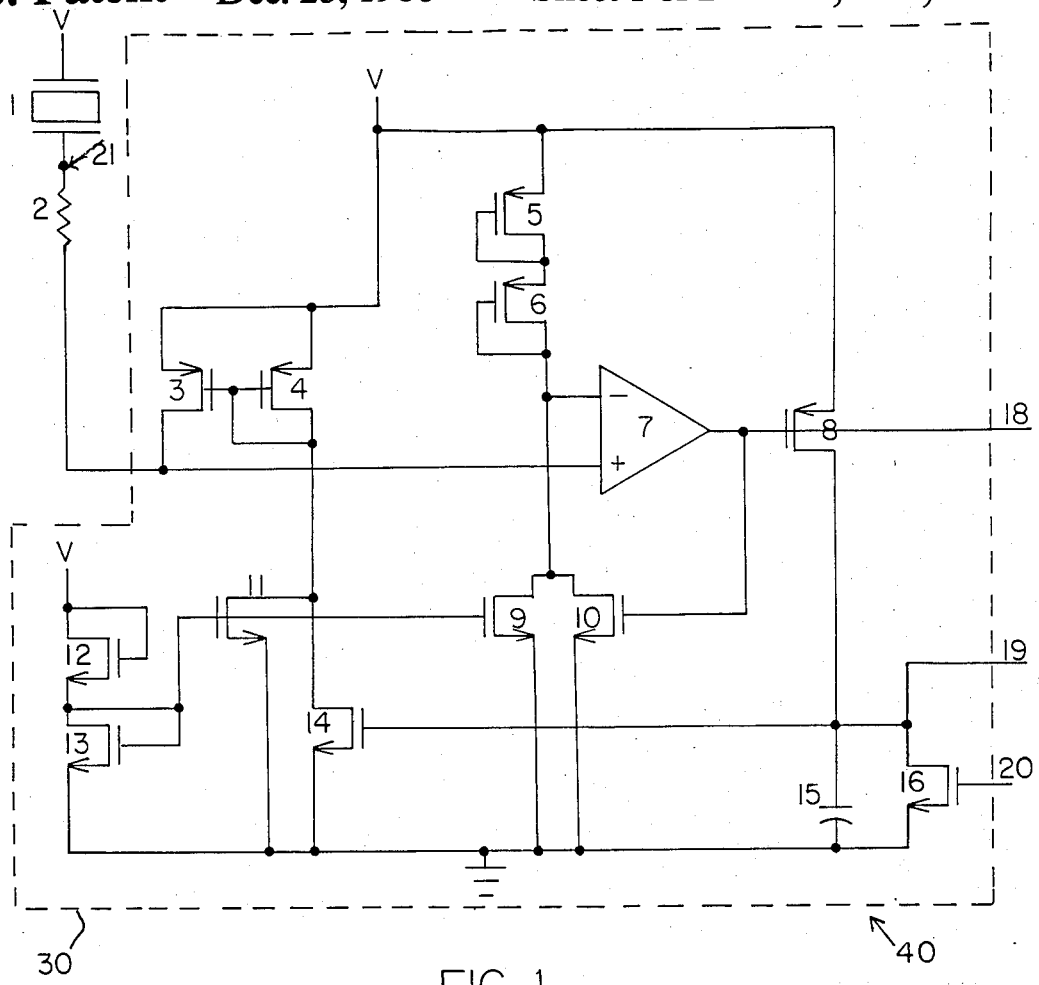
FIG. 1 is a schematic diagram of one embodiment of a circuit constructed in accordance with the present invention.
Figure 2:
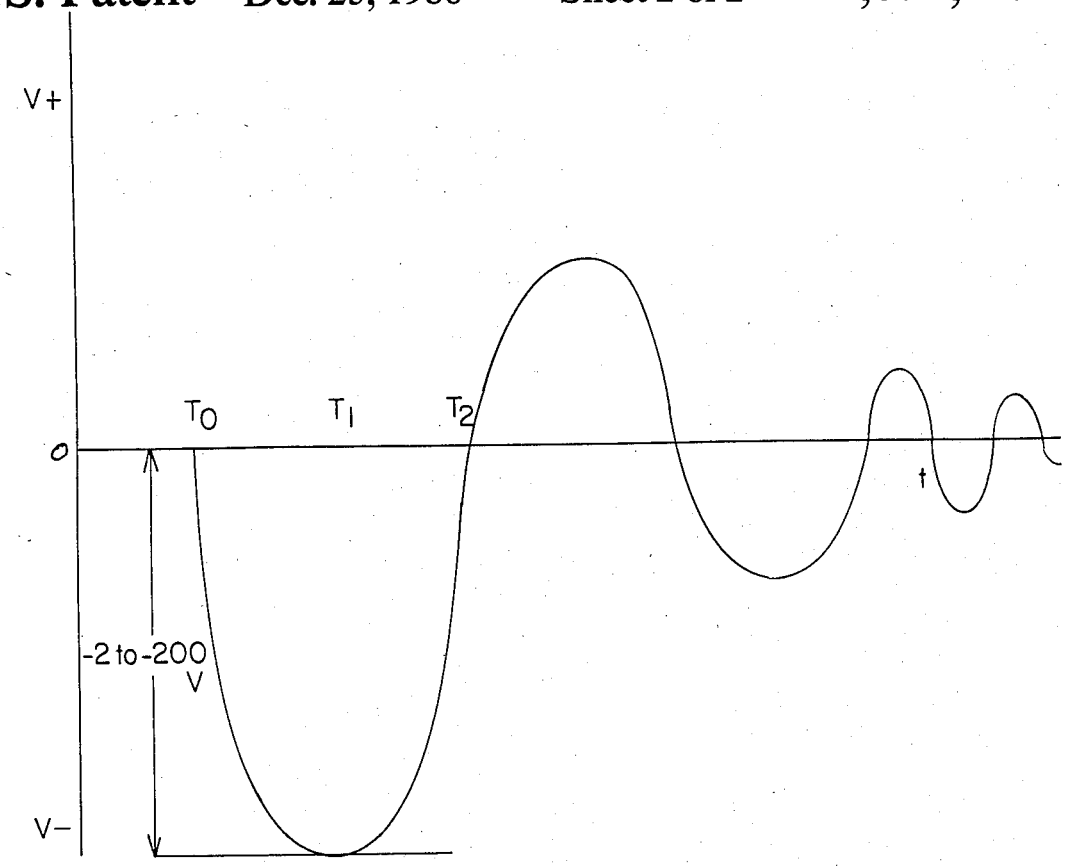
FIG. 2 is a graph depicting the negative going peak voltage when a piezoelectric transducer is struck.

Circuit 40 in FIG. 1 includes piezoelectric transducer 1. When piezoelectric transducer 1 is struck a single time, a large negative voltage pulse followed by declining sinusoidal pulses are produced, as shown in FIG. 2. Capacitor 15 in FIG. 1 stores a charge which is proportional to the square root of the peak voltage provided by piezoelectric transducer 1.

N channel MOS transistors 12 and 13 of FIG.1 form a constant current source.

Since $V_{GS}(12) = V_{DS}(12)$, where $V_{GS}(12)$ = the gate to source voltage of MOS transistor 12, and $V_{DS}(12)$ = the drain to source voltage of MOS transistor 12, and $V_{GS}(13) = V_{DS}(13)$, where $V_{GS}(13)$ = the gate to source voltage of MOS transistor 13, and $V_{DS}(13)$ = the drain to source voltage of MOS transistor 13 then $V_{GS}(12) - V_T < V_{DS}(12)$ and $V_{GS}(13) - V_T < V_{DS}(13)$, where $V_T$ = the threshold voltage of $N$ channel MOS transistor in circuit 40, thus transistors 12 and 13 are both saturated. For simplicity throughout this specification, a number in parentheses to the right of a variable, indicates the component to which the variable applies, e.g., $V_{GS}(1)$ is the gate to source voltage drop in N channel MOS field effect transistor 1. The threshold voltage $V_t$ of a metal oxide semiconductor transistor is determined by several factors (i.e. gate oxide thickness, channel doping level, etc.) of the transistor, see Millman & Hilkis, Integrated Electronics: Analog and Digital Circuits and Systems, page 323 (1972) which is hereby incorporated by reference. All N channel MOS devices in this embodiment are fabricated so that these factors, and thus the threshold voltage, are equal in all N channel MOS transistors. Similarly, all P-channel MOS devices in this embodiment are constructed so that these factors are equal in all P-channel MOS transistors.

Since transistor 12 is saturated, $$I_{DS}(12) = \frac{\mu e}{2T} \frac{W(12)}{L(12)} (V_{GS12} - V_T)^2, \text{ where}$$

$I_{DS}(12)$ = The drain current of transistor 12;
$\mu$ is the average surface mobility of charge carriers in the channel,
$T$ is the thickness of the oxide over the channel,
$e$ is the permitivity of the oxide,
$W(12)$ = the channel width of transistor 12, and
$L(12)$ = the channel length of transistor 12.
Since
$V_{GS}(12) = V - V_S(12)$ and $V_S(12) = V_{GS}(13)$, where
V = The voltage level of supply voltage V, -continued $V_S(12)$ = The voltage on the source of transistor 12 and $V_{GS}(12) = V - V_{GS}(13)$ then $$I_{DS}(12) = \frac{\mu e}{2T} \frac{W_{12}}{L_{12}} (V_{GS}(12) - V_T)^2$$

$$= \frac{\mu e}{2T} \frac{W(12)}{L(12)} (V - V_{GS}(13) - V_T)^2$$

Since $Q_{13}$ is saturated:

$$I_D(13) = \frac{\mu e}{2T} \frac{W(13)}{L(13)} (V_{GS}(13) - V_T)^2 \text{ where}$$

$I_{DS}(13)$ = the drain current of transistor 13 which implies $$V_{GS}(13) - V_T = \left( \frac{2 \cdot I_{DS}(13) T \cdot L(13)}{\mu e \cdot W(13)} \right)^{\frac{1}{2}}$$

$W(13)/L(13)$ is large enough so that $$\frac{2 \cdot I_{DS}(13)}{\mu_o C_{ox} W(13)/L(13)} \cong 0.$$

Therefore,
$V_{GS}(13) - V_T \cong 0$ which implies $V_{GS}(13) \cong V_T$,
so $$I_{DS}(12) = \frac{\mu_o C_{ox}}{2} W(12)/L(12)(V - 2V_T)^2$$

Then setting $W(12)/L(12)$ small forces $I_{DS}(12)$ small since everything else is fixed. If $I_{DS}(12)$ is small since $I_{DS}(12) = I_{DS}(13)$, where
$I_{DS}(13)$ = the source to drain current in transistor 13, then $I_{DS}(13)$ is small which helps strengthen the previous condition that $$\frac{2 I_{DS}(13) T}{\mu e \, W(13)/L(13)} \cong 0 \quad (2)$$

Another equation which represents the relationship between the gate to source voltage and the drain to source current in a field effect transistor when the transistor is saturated is the equation, $$I_{DS} = I_{DSS} \left( 1 - \frac{V_{GS}}{VT} \right)^2 \text{ where,} \quad (3)$$

$I_{DSS}$ is a constant determined by the physical size and formation process used to form the transistor (as more fully defined later).
Solving this equation for $V_{GS}$, $$V_{GS} = V_T \left( 1 + \frac{I_{DS}}{I_{DSS}} \right)^{\frac{1}{2}}. \quad (4)$$

Because the gate of transistor 13 is connected to the gate of transistor 11 and the source of transistor 13 is connected to the source of transistor 11, $V_{GS}$ in transistor 13 is equal to $V_{GS}$ in transistor 11. Thus, equating the two gate to source voltages, the drain current equation becomes $$V_T \left( 1 + \frac{I_{DS}(13)}{I_{DSS}(13)} \right)^{\frac{1}{2}} = V_T \left( 1 + \frac{I_{DS}(11)}{I_{DSS}(11)} \right)^{\frac{1}{2}} \quad (5)$$

By eliminating $V_T$ and squaring both sides, the drain to source current equation becomes $$I_{DS}(11) = \frac{I_{DSS}(11)}{I_{DSS}(13)} I_{DS}(13) \quad (6)$$

$I_{DSS}$ is determined by the equation, $$I_{DSS} = \frac{\mu e V_t^2}{2T} \frac{W}{L} \quad (7)$$

Because all N channel MOS field effect transistors are constructed using the same fabrication process, $\mu$, T, e, and $V_T$ are equal in all N-channel MOS field effect transistors in the circuit. Therefore, the drain to source current equation becomes $$I_{DS(11)} = \left( \frac{W(11)/L(11)}{W(13)/L(13)} \right) I_{DS}(13). \quad (8)$$

Thus, the current in transistor 11 is proportional to the current in transistor 1, with the proportionality constant depending upon the relative widths and lengths of transistors 13 and 11. Equations 3 through 7 are valid when the MOS field effect transistors are operated in the saturation mode as they are in this circuit, see *MOS Integrated Circuits: Theory, Fabrication, Design, and Systems Applications of MOS LSI*, Penney Ed., P. 69, (1979), which is hereby incorporated by reference. Thus, the current in transistor 11 is proportional to the current in transistor 13, with the proportionality constant depending upon the relative widths and lengths of transistors 13 and 11. This arrangement where the gates are connected together and the sources are connected together in an MOS field effect transistor circuit is known as a "current mirror". The constant current through transistor 13 is mirrored to transistors 11 and 9.

Figure 3:
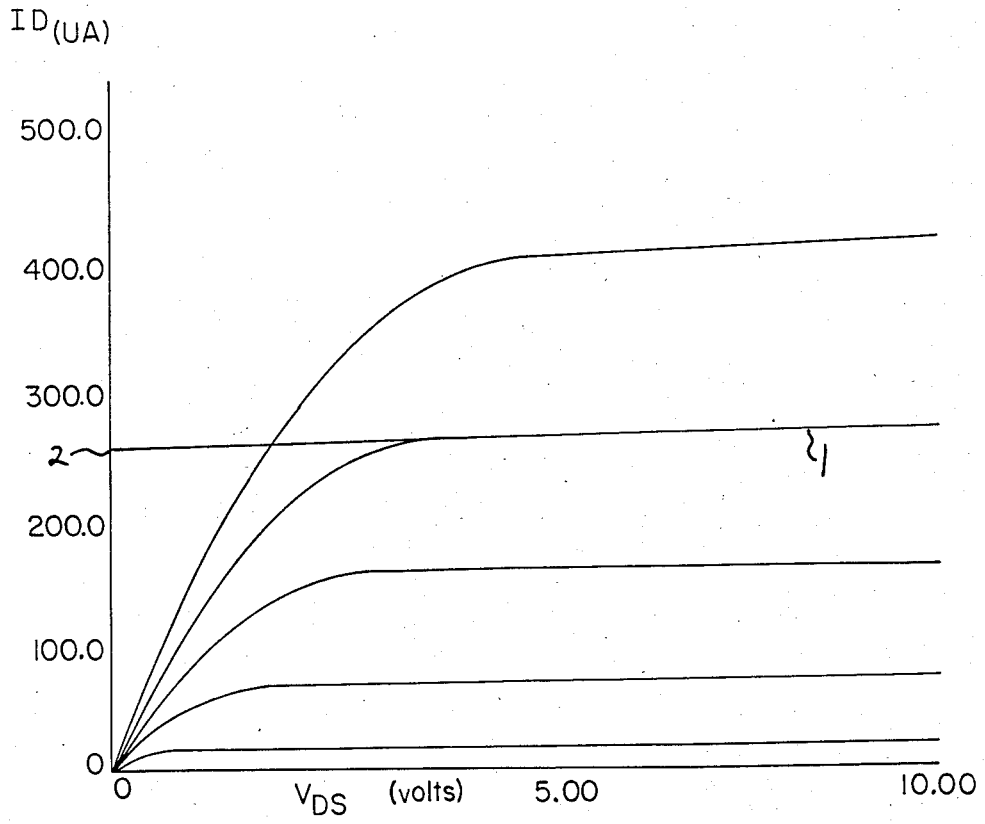
FIG. 3 is a graph depicting the characteristic curves of a typical MOS field effect transistor.

When there is no voltage across piezoelectric transducer 1, transistor 14 is off, as is explained later. Therefore, the current through transistor 4 is equal to the current through transistor 11. The current in transistor 4 is mirrored by transistor 4 to transistor 3. In the described embodiment, the current through transistor 3 is equal to the current through transistor 4 because the widths and lengths of transistors 3 and 4 are equal, thus providing a ratio of proportionality of one (see equation 8). In other embodiments, the widths and lengths of transistors 3 and 4 are selected so as to provide other ratios of proportionality. FIG. 3 shows a family of curves representing the voltage between the drain to source versus the drain to source current. Each curve represents a specific value of gate to source voltage, *MOS Integrated Circuits: Theory Fabricaton, Design, and Systems Applications of MOS LSI/*, FIG. 2–18, Page 67, Penney Ed.(1979). The current mirror formed by transistor 4 and transistor 3 provides a constant gate to source voltage $V_{GS}(3)$ for transistor 3. This constant voltage is represented by curve 1 of FIG. 3. Current value 2 is the drain to source current of transistor 3 in the saturation region of curve 1. This is the current mirrored from transistor 4 to transistor 3. For the current in transistor 3 to fall below level 2, the drain to source voltage across transistor 13 must fall below the saturation region into the steep portion of curve 1. If the current drawn through transistor 2 by piezoelectric transducer 1 is much less than the current mirrored from transistor 4 to transistor 3, the drain to source voltage drop across transistor 3 is nearly equal to zero.

The current mirrored to transistor 9 from transistor 13 is drawn through transistors 5 and 6. This current develops a gate to source voltage drop across transistors 5 and 6. Therefore, the inverting input signal of comparator 7 is two gate to source voltage drops ($V_{GS}$) below positive voltage source V17. Because the voltage at the noninverting input lead of comparator 7 is the drain to source voltage drop of transistor 3 (nearly equal to zero) below voltage source V17 and the voltage at the inverting input lead of comparator 7 is two gate to source voltage drops ($V_{GS}$) below positive voltage source V17, the output signal of comparator 7 is a logical 1. Therefore, P-channel MOS transistor 8 is off and N-channel MOS transistor 10 is on.

At the beginning of a measurement cycle, a high voltage is placed on reset input lead 20. This turns on transistor 16. Transistor 16 discharges capacitor 15. Reset input lead 20 is then brought to a low voltage level, thereby turning off transistor 16.

When piezoelectric transducer 1 is struck, the voltage at node 21 goes to a large negative value below V17. Transistor 3 limits the current flowing from positive voltage source V17 through resistor 2. Therefore, a voltage drop appears across transistor 3. This voltage drop pulls the noninverting input signal of comparator 7 below the inverting input signal of comparator 7, and the output lead of comparator 7 thus provides a logical 0. The logical 0 output signal of comparator 7 turns on transistor 8. In addition, a logical 0 is provided on output node 18. Output node 18 is provided to indicate to other circuitry (not shown) when an input signal is being received from piezoelectric transducer 1. The current from transistor 8 charges capacitor 15. As the current from transistor 8 charges capacitor 15, the voltage across capacitor 15 also appears across the gate and source of transistor 14. Therefore, transistor 14 begins to conduct. The current through transistor 14 increases the current mirrored by transistor 4 to transistor 3. The increased current causes more of the voltage drop between voltage source V17 and node 21 to be across resistor 2. The voltage across capacitor 15, and therefore the current through transistor 14, continues to increase until the voltage drop across transistor 3 is less than the voltage drop across transistors 5 and 6. This occurs when the current through transistor 3 and thus resistor 2 is nearly equal to the current that would flow through resistor 2 if the second lead of resistor 2 were connected directly to positive voltage source 17 rather than the drain of transistor 3. Therefore, the current through transistor 4 and transistor 14 is approximately proportional to the current through resistor 2, because the current through transistor 11 is relatively small. Therefore, capacitor 15 continues to be charged until the voltage across capacitor 15 is sufficient to create the necessary current through transistor 14. The current in a field effect transistor varies with the square of the gate to source voltage times a characteristic constant of the transistor $I_{DSS}$, as explained above. Therefore, the voltage across capacitor 15 when the output signal of comparator 7 is a logical 1 is proportional to the square root of the voltage across piezoelectric transducer 1. That proportionality constant is determined by the value of resistor 2 and the characteristics of transistors 3, 4 and 14. The output signal of circuit 40 is the voltage stored on capacitor 15 as provided on output terminal 19.

Transistor 10 is a very narrow long channel device and thus is like a high resistance and draws very little current. Therefore, the current drawn by transistor 10 is very small. When the noninverting input signal of comparator 7 is more positive than the inverting input signal of comparator 7, and then the noninverting input signal becomes more negative than the inverting input signal, the output signal of comparator 7 becomes a logical 0 and transistor 10 turns off. When the output signal of comparator 7 switches from a logical 1 to a logical 0, transistor 10 turns off and therefore the current through transistors 5 and 6 decreases, thereby decreasing the voltage drop across transistors 5 and 6. Therefore, the inverting input signal of comparator 7 is pulled to an even higher voltage level than that necessary to switch the output signal of comparator 7 from a logical 1 to a logical 0. Conversely, when the output signal of comparator 7 switches from a logical 0 to a logical 1, transistor 10 turns on. Therefore, the current through transistors 5 and 6 increases, thereby increasing the voltage drop across transistors 5 and 6. Therefore, the inverting input signal of comparator 7 goes to an even lower voltage level than that necessary to switch the output signal of comparator 7 from a logical 0 to a logical 1. Transistor 10 is used to pull up or pull down the inverting input lead of comparator 7 in order to prevent the circuit from oscillating at the point where the voltage on capacitor 15 reaches a compressed value corresponding to the peak voltage provided by the piezoelectric transducer 1.

The semisinusoidal waveform shown in FIG. 2 is the waveform produced by piezoelectric transducer 1 (FIG. 1) when struck. The output signal of comparator 7 in FIG. 1 is a logical 0 and the voltage across capacitor 15 increases until the transducer voltage reaches its peak at time T1. At this time, the voltage on capacitor 15 is proportional to the square root of the transducer peak voltage and is provided on output node 19. When the transducer voltage begins to fall, the output signal of comparator 7 becomes a logical 1 and the voltage on capacitor 15 is held fixed until a logical 1 reset signal is received on reset input terminal 20, which discharges capacitor 15 in order to allow receipt of another input signal from transducer 1.

While this specification illustrates specific embodiments of this invention, it is not to be interpreted as limiting the scope of the invention. Many embodiments of this invention will become evident to those of ordinary skill in the art in light of the teachings of this specification.

I claim:

1. A voltage compressing electronic circuit comprising:

a voltage source having a first lead connected to a first voltage source and a voltage source output lead for providing a large transient peak voltage;

a resistor having a first lead connected to said voltage source output lead of said input voltage source and having a second lead;

a means for comparing two current values having a first input lead connected to said second lead of said resistor, a second input lead, an output lead for providing an output signal, wherein said output signal is high when said first input lead carries a larger current than said second input lead, and wherein said output signal is low when said second input lead carries a larger current than said first input lead; and a variable current source having a current output lead connected to said second input lead of said means for comparing, an input lead connected to said output lead of said means for comparing, and a reset input node, wherein when said input lead receives a low voltage, the current on said current output lead increases in proportion with the time said input node receives a low voltage, wherein said output lead of said means for comparing provides an output voltage having a selected mathematical relationship with the current provided by said current output lead, and wherein said current source supplies no current when said reset input node receives a high voltage level.

2. A voltage compressing electronic circuit as in claim 1 wherein said input voltage source is a piezoelectric transducer.

* * * * *